US006581815B1

(12) United States Patent
Ho et al.

(10) Patent No.: US 6,581,815 B1
(45) Date of Patent: Jun. 24, 2003

(54) NAILING DEPTH ADJUSTING AND POSITIONING DEVICE FOR A POWER NAILER

(75) Inventors: Roman Ho, Taichung (TW); An-Gi Liu, Taichung (TW); Sheng-Man Wang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/313,459

(22) Filed: Dec. 6, 2002

(51) Int. Cl.[7] ..... B25C 1/04
(52) U.S. Cl. ..... 227/142; 227/8
(58) Field of Search ..... 227/8, 142, 130

(56) References Cited

U.S. PATENT DOCUMENTS 5,219,110 A * 6/1993 Mukoyama ..... 227/8
5,385,286 A * 1/1995 Johnson, Jr. ..... 227/142
5,579,977 A * 12/1996 Yang ..... 227/8
6,012,622 A * 1/2000 Weinger et al. ..... 227/142
6,024,267 A * 2/2000 Chen ..... 227/142
6,170,729 B1 * 1/2001 Lin ..... 227/142

* cited by examiner

*Primary Examiner*—Scott A. Smith
(74) *Attorney, Agent, or Firm*—Charles E. Baxley

(57) ABSTRACT

The present invention is to provide a nailing depth adjusting and positioning device for a power nailer in order to protect the distal thread and stabilize the operation. The device having a circular groove formed in a rotatable member and a retainer ring located in a link in order to prevent the rotatable member from being overly rotated (to protect the distal thread), and the disengagement of the device, and having a steel ball and a spring mounted in the rotatable member, the steel ball cooperates with the several gaps in the safety device to locate the rotatable member, such that the starting distance of the device may stably be adjusted. Thereby, the depth of nailing and the position may be successively maintained.

1 Claim, 6 Drawing Sheets

NAILING DEPTH ADJUSTING AND POSITIONING DEVICE FOR A POWER NAILER

BACKGROUND OF THE INVENTION

1. Field of the Invention

The present invention relates to a power nailer, and more particularly, to a nailing depth adjusting and positioning device for a power nailer.

2. Description of the Related Art

A conventional nailing depth adjusting devices for power nailers are shown in FIGS. 1 and 2, disclose two power nailers with same technological principle, which are both comprised of a distal end threaded link 10 to cooperate with a plate 11, an interior threaded nut 12 and a spring 13. When an user operates an conventional power nailer, the plate 11 contacts a work piece's surface, and then the link 10 is actuated by pushing the plate 11 against the work piece, such that the power nailer is in a stand-by condition, as long as the user pushes a trigger, a nail can be rapidly ejected. The starting distance of the plate 11 only can be adjusted by cooperating with a work piece, accordingly, in operation, the plate 11 is usually movable by rotating the nut 12 whereby to adjust the distance between power nailer and work piece. Although such conventional device still can be used and capable of adjusting the depth of nailing, during real operation, there are still drawbacks to be improved and some problems will occur:

1. Starting distance of the plate 11 is adjusted by rotating the nut 12 whereby to move the plate 11, but the distal thread of the link 10 will not be engaged well with the interior thread of the nut 12 when the link 10 is over moved by rotating the nut 12 (when rotating the nut 12 too much), such that the link 10 disengages from the nut 12, endangering the safe operation.

2. Starting distance of the plate 11 has to keep equivalence by cooperating with different work pieces, in this case, the successive maintenance of the distance becomes very important. While there is no preferred positioning design in conventional nailing depth adjusting for a power nailer to fix the distance of the plate 11, it is inconvenient for users to adjust the nut 12 repeatedly during operation.

The present invention has arisen to mitigate the afore-described disadvantages of the conventional nailing depth adjusting and positioning device for a power nailer.

SUMMARY OF THE INVENTION

The present invention has arisen to mitigate and/or obviate the disadvantage of the conventional web-shaped product.

The primary objective of the present invention is to provide a nailing depth adjusting and positioning device for a power nailer having a circular groove formed in a rotatable member and a retainer ring located in a link whereby to prevent the rotatable member from being overly rotated (to protect the distal thread), and the disengagement of the device.

Another objective of the present invention is to provide a nailing depth adjusting and positioning device for a power nailer having a steel ball and a spring mounted in the rotatable member, the steel ball cooperates with the several gaps in the safety device to locate the rotatable member, such that the starting distance of the device may stably be adjusted and the user has not to adjust repeatedly.

In accordance with the present invention, there is provided a nail depth adjusting and positioning device for a power nailer comprising a link which is a rod moveably mounted on the power nailer. The link has a nose rod on a first end thereof to connect to a trigger of said power nailer, and a connection plate extending laterally from a second end of said link. The connection plate has a sleeve and a top plate defined in a distal end thereof. A step hole is formed in the sleeve, and a circular groove is defined adjacent to an opening of the sleeve which faces toward a muzzle of the power nailer. The step hole has a bigger bore at its upper position and a smaller threaded bore at its lower position. The circular groove is defined two through holes in connection with the step hole. A spring has a first end mounted to the sleeve and a second end engaging a body of the power nailer. A rotatable member includes a wheel body, a step rod and a positioning rod. The wheel body has a plurality of anti-sliding threads on a surface thereof. The step rod is formed at a side of the wheel body and received in the step hole of the sleeve. The step rod includes a screw section, a sliding section and a ring section. The screw section has a plurality of threads on a surface thereof, and is located at a first end of the step rod. The screw section is threadly engaged with a smaller threaded bore of the step hole. The sliding section is located at a second end of the step rod adjacent to the wheel body, and the ring section is located between the screw section and the sliding section. A side of said ring section forms a stopper due to the diameter of said ring section is bigger than the diameter of the sliding section. The length of the sliding section is shorter than the length of the screw section. In addition, the positioning rod has a circular groove defined threreon, and a recess hole is defined between said circular groove and the wheel body. A spring and steel ball are put into the recess hole in turn. A push member has a crown bar in correspondence with a work piece and a positioning seat extends laterally from an end of the crown bar. The positioning seat has a central hole defined therethrough and a plurality of gaps defined in an inner periphery defining the central hole. The push member is mounted to the positioning rod and the steel ball mates with one of the gaps so that when the rotatable member is rotated, the steel ball can change the position from one gap to the other. A C-shaped fastener is located in the circular groove so that the rotatable member will not disengage from the central hole of the push member because a diameter of the C-shaped fastener is larger than the central hole.

Further benefits and advantages of the present invention will become apparent after a careful reading of the detailed description with appropriate reference to the accompanying drawings.

DETAILED DESCRIPTION OF THE INVENTION

Figure 1:
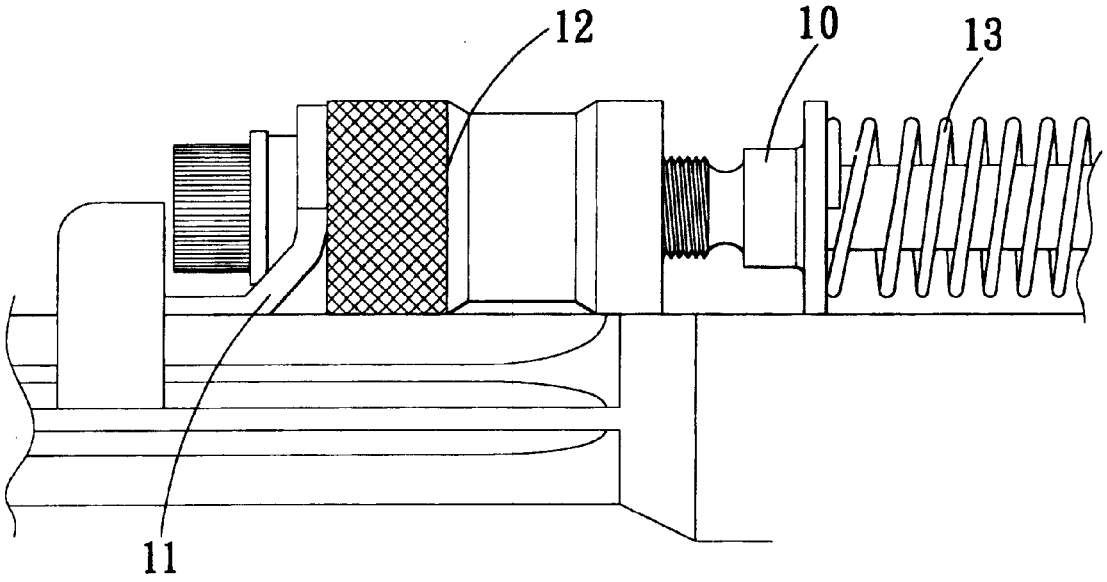
F I G. 1 PRIOR ART
FIG. 1 is a side elevational view of a conventional nailing depth adjusting device for a power nailer.
Figure 2:
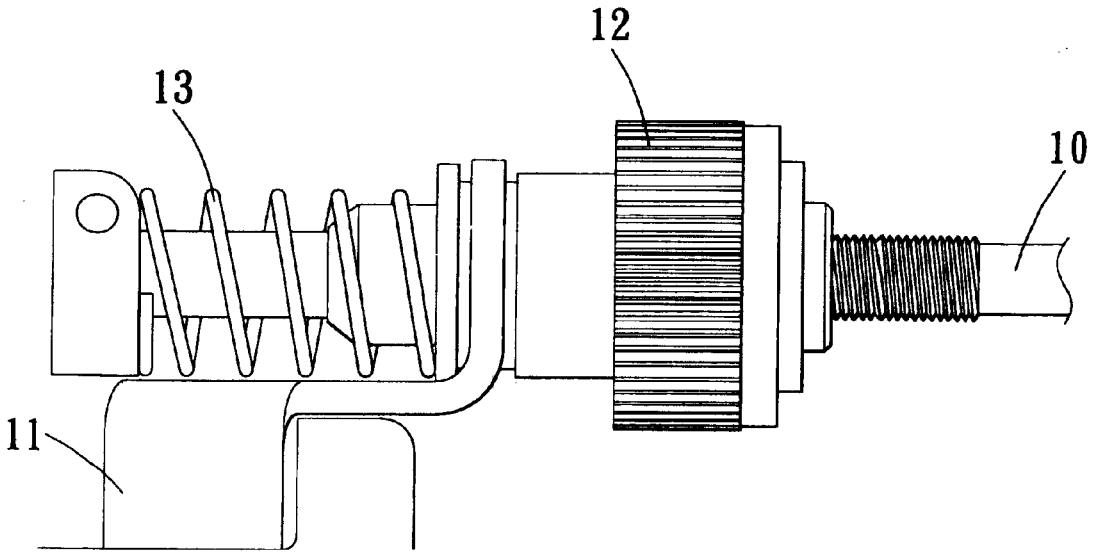
F I G. 2 PRIOR ART
FIG. 2 is a side elevational view of another conventional nailing depth adjusting device for a power nailer.
Figure 3:
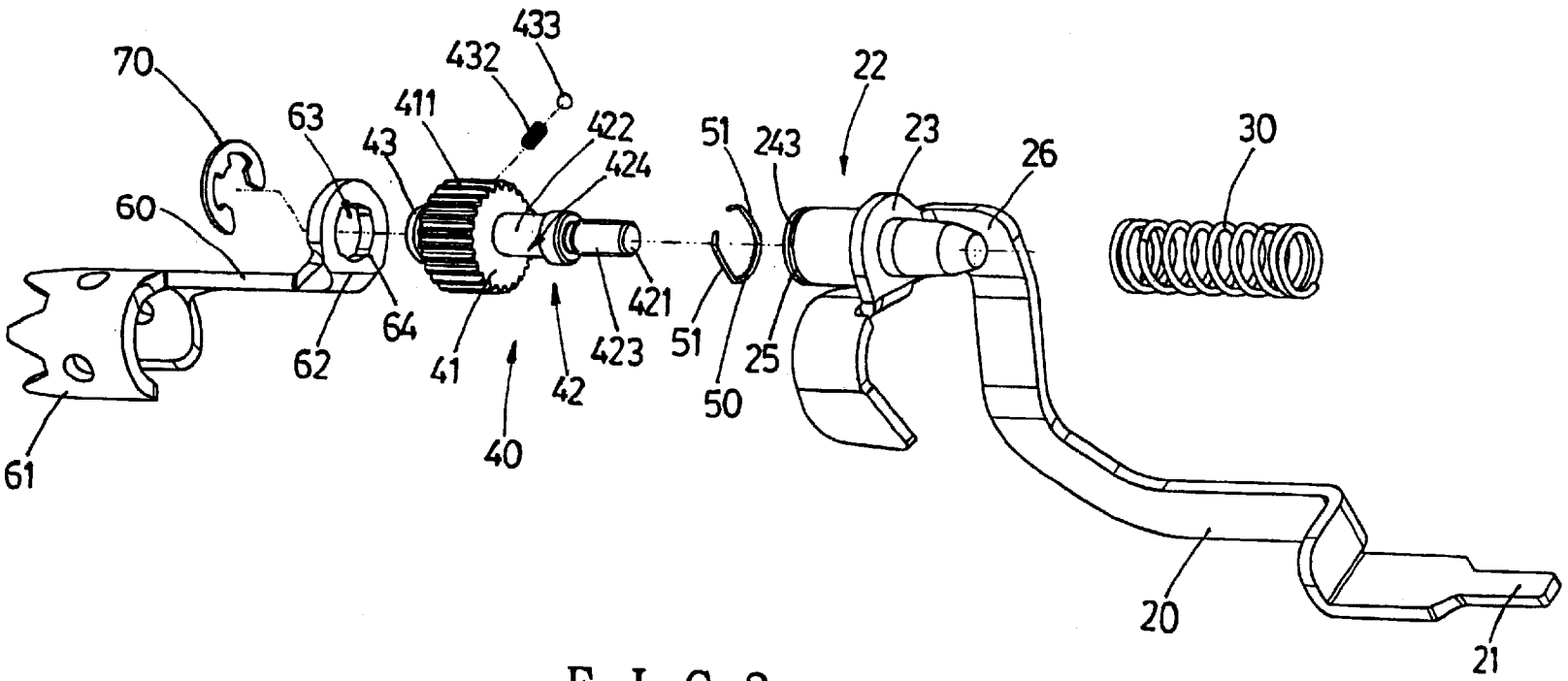
FIG. 3 is an exploded view to show a nailing depth adjusting and positioning device for a power nailer of the present invention.
Figure 4:
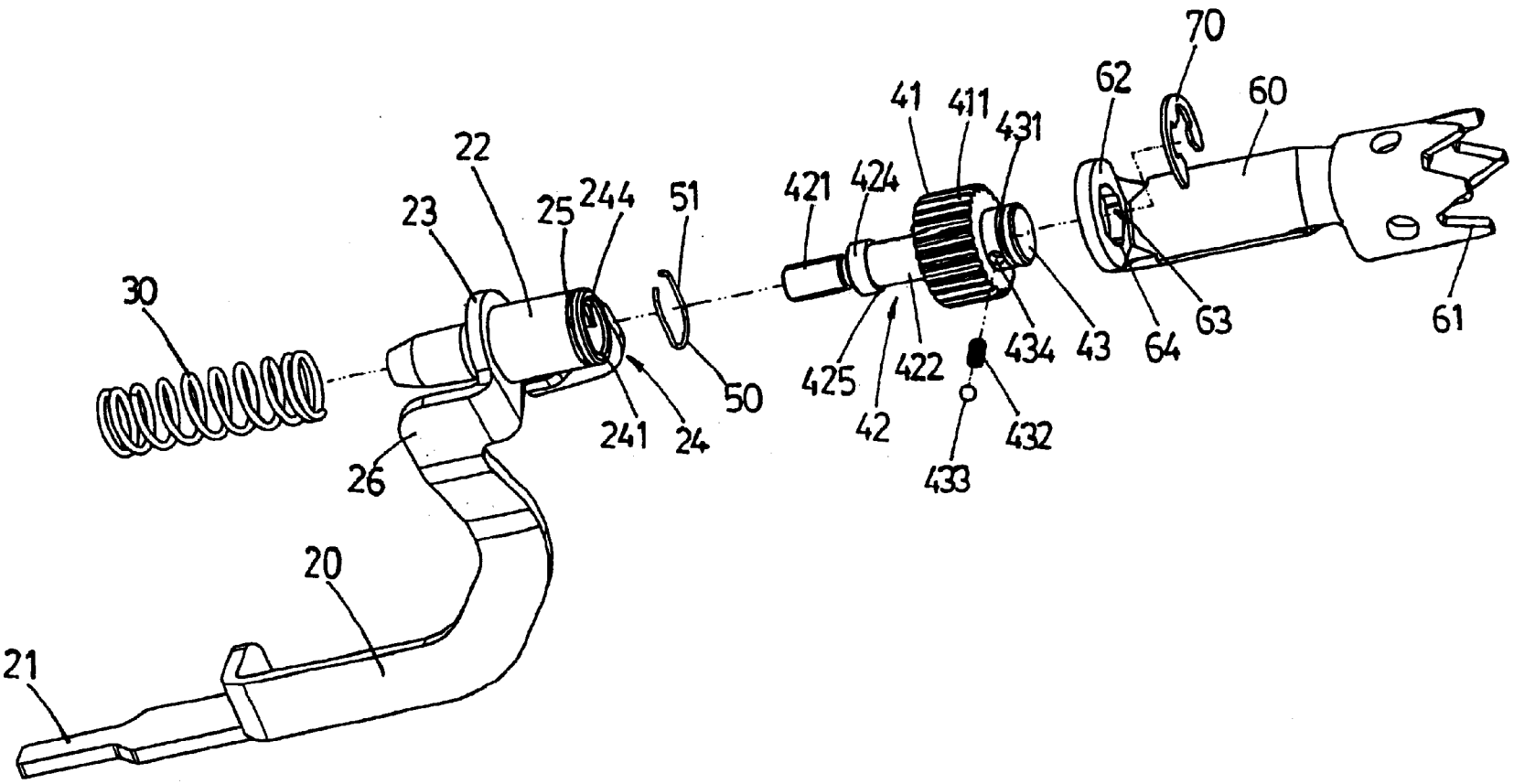
FIG. 4 is an exploded view to show the other side of a nailing depth adjusting and positioning device for a power nailer of the present invention.
Figure 5:
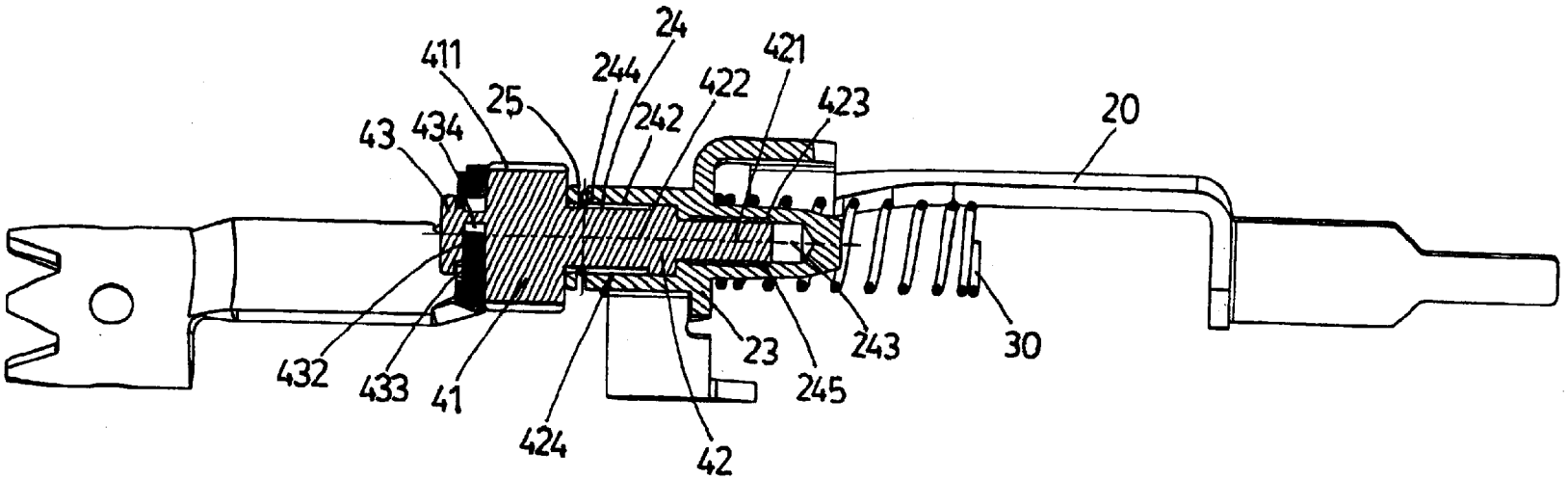
FIG. 5 is a side elevational view, partly in section, of a nailing depth adjusting and positioning device for a power nailer in accordance with the present invention, wherein the rotatable member is in its lowermost position.

Referring to FIGS. 3 to 5, the nailing depth adjusting and positioning device for a power nailer of the present invention comprises a link 20, a spring 30, a rotatable member 40, a retainer ring 50, a push member 60 and a C-shaped fastener 70.

The link 20 has a nose rod 21 on a first end of the link 20 to connect to a trigger of the power nailer, and a connection plate 26 extending laterally from a second end of the link 20. The body of the link 20 is movably mounted on the power nailer. The connection plate 26 has a sleeve 22 and a top plate 23 defined in a distal end thereof. A step hole 24 is formed in the sleeve 22, and a circular groove 25 is defined adjacent to an opening 241 of the sleeve 22. The opening 241 of the sleeve 22 faces toward a muzzle of the power nailer. The step hole 24 has a bigger bore 242 at its upper position, and has a smaller threaded bore 243 at its lower position. The circular groove 25 is defined two through holes 244 in connection with the step hole 24.

The sleeve 22 extends from the second of the link 20 so that the spring 30 has a first end mounted to the sleeve 22, and a second end of the spring 30 contacts a body of the power nailer. Therefore, when the link 20 is pushed toward the body of the power nailer, the spring 30 is compressed.

The rotatable member 40 includes a wheel body 41, a step rod 42 and a positioning rod 43. The wheel body 41 has a plurality of anti-sliding threads 411 on a surface thereof. The step rod 42 is formed at a side of the wheel body 41, and is received in the step hole 24 of the sleeve 22. The step rod 42 includes a screw section 421, a sliding section 422 and a ring section 424. The screw section 421 has a plurality of threads 423 on a surface thereof, and is located at a first end of the step rod 42. The screw section 421 is threadly engaged with the smaller threaded bore 243 of the step hole 24. The sliding section 422 is located at a second end of the step rod 42 adjacent to the wheel body 41. The ring section 424 is located between the screw section 421 and the sliding section 422. As shown in FIG. 4, the diameter of the ring section 424 is bigger than the diameter of the sliding section 422, so a side of the ring section 424 can form a stopper 425. The length of the sliding section 422 is shorter than the length of the screw section 421. In addition, the positioning rod 43 has a circular groove 431 defined thereon, and a recess hole 434 is defined between the circular groove 431 and the wheel body 41. A spring 432 and a steel ball 433 are put into the recess hole 434 in turn.

The retainer ring 50 has two protrusions 51 defined thereon, and can be installed in the circular groove 25. The two protrusions 51 just mates with the two through holes 244 of the circular groove 25, and partially extends from the two through holes 244 so that when the rotatable member 40 is moved, the two protrusions 51 can contact with the sliding section 422.

The push member 60 has a crown bar 61 in correspondence with a work piece and a positioning seat 62 extends laterally from an end of the crown bar 61. The positioning seat 62 has a central hole 63 defined therethrough and a plurality of gaps 64 are defined in an inner periphery defining the central hole 63. The push member 60 is mounted to the positioning rod 43 and the steel ball 433 mates with one of the gaps 64 so that when the rotatable member 40 is rotated, the steel ball 433 can change the position from one gap 64 to another gap 64. The gaps 64 may be disengaged from the steel ball 433 of the positioning rod 43 against the spring 432 such that the rotatable member 40 may be rotated relative to the push member 60 and may be positioned relative to the push member 60 again when the gaps 64 are engaged with the steel ball 433 again.

The C-shaped fastener 70 is located in the circular groove 431 so that the rotatable member 40 will not disengaged from the central hole 63 of the push member 60 because a diameter of the C-shaped fastener 70 is larger than the central hole 63.

Figure 6:
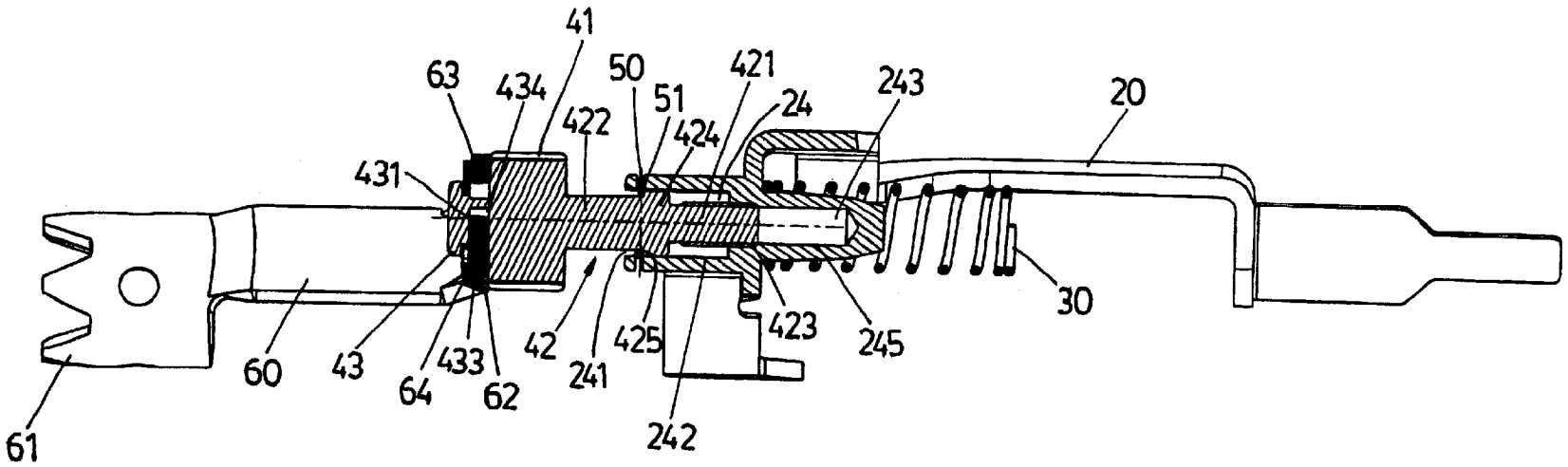
FIG. 6 is a side elevational view, partly in section, of a nailing depth adjusting and positioning device for a power nailer in accordance with the present invention, wherein the rotatable member is in its uppermost position.

Referring now to FIGS. 5 and 6, when rotating the wheel body 41 to let the link 20 be moved toward the push member 60 along the screw section 421 of the rotatable member 40, the work piece (not shown) to be nailed is located close to the power nailer so that the nailing depth will be the deepest. Otherwise, when rotating the wheel body 41 in an opposite direction, the link 20 be moved away from the push member 60 along the screw section 421 of the rotatable member 40, the work piece (not shown) to be nailed is located far away from the power nailer so that the nailing depth will be the nail only penetrates shallow.

It is to be noted that the steel ball 433 of the rotatable member 40 may be sequentially received into the gaps 64 of the positioning seat 62 of the push member 60 such that the steel ball 433 under the limit of the gap 64 can keep in a steady state.

Referring to FIG. 6, when the rotatable member 40 is moved away from the push member 60 to reach the farthest position, the two protrusions 51 of the retainer ring 50 are just stopped by the stopper 425, such that the screw section 421 of the rotatable member 40 may still be engaged with the smaller threaded bore 243 of the step hole 24 of the link 20. In other words, by this time, the screw section 421 of the rotatable member 40 does not separate with the smaller threaded bore 243 of the step hole 24 of the link 20. Thus, not only a distal thread 423 of the screw section 421 but also the smaller threaded bore 243 may be protected.

While we have shown and described various embodiments in accordance with the present invention, it should be clear to those skilled in the art that further embodiments may be made without departing from the scope of the present invention.

What is claimed is:

1. A nailing depth adjusting and positioning device for a power nailer, comprising:

a link moveably mounted on the power nailer having a nose rod on a first end of said link to connect to a trigger of said power nailer, a connection plate extending laterally from a second end of said link, said connection plate having a sleeve and a top plate defined in a distal end thereof, a step hole formed in said sleeve and a circular groove defined adjacent to an opening of said sleeve, said opening of said sleeve facing toward a muzzle of said power nailer, said step hole having a bigger bore at its upper position and a smaller threaded bore at its lower position, said circular groove defined two through holes in connection with said step hole;

a spring having a first end mounted to said sleeve and a second end contacting a body of said power nailer;

a rotatable member including a wheel body, a step rod and a positioning rod, said wheel body having a plurality of anti-sliding threads on a surface thereof, said step rod formed at a side of said wheel body and received in said step hole of said sleeve, said step rod including a screw section, a sliding section and a ring section, said screw section having a plurality of threads on a surface thereof and located at a first end of said step rod, said screw section threadly engaged with a smaller threaded bore of said step hole, said sliding section located at a second end of said step rod adjacent to said wheel body, said ring section located between said screw section and said sliding section, a side of said ring section formed a stopper due to the diameter of said ring section being bigger than the diameter of said sliding section, the length of said sliding section being shorter than the length of said screw section, in addition, said positioning rod having a circular groove defined thereon and a recess hole defined between said circular groove and said wheel body, a spring and steel ball put into said recess hole in turn;

a push member having a crown bar in correspondence with a work piece and a positioning seat extending laterally from an end of said crown bar, said positioning seat having a central hole defined therethrough and a plurality of gaps defined on an inner periphery of the central hole, said push member mounted to said positioning rod and said steel ball mating with one said gaps so that when said rotatable member is rotated, said steel ball can change the position from one gap to the other;

a C-shaped fastener located in said circular groove so that said rotatable member will not disengage from said central hole of said push member.

* * * * *